US008500983B2

(12) United States Patent
Ponnuswamy et al.

(10) Patent No.: US 8,500,983 B2
(45) Date of Patent: Aug. 6, 2013

(54) PULSE SEQUENCE FOR PLATING ON THIN SEED LAYERS

(75) Inventors: Thomas A. Ponnuswamy, Sherwood, OR (US); Bryan Pennington, Sherwood, OR (US); Clifford Berry, West Linn, OR (US); Bryan L. Buckalew, Tualatin, OR (US); Steven T. Mayer, Lake Oswego, OR (US)

(73) Assignee: Novellus Systems, Inc., Fremont, CA (US)

( * ) Notice: Subject to any disclaimer, the term of this patent is extended or adjusted under 35 U.S.C. 154(b) by 114 days.

(21) Appl. No.: 12/786,329

(22) Filed: May 24, 2010

(65) Prior Publication Data

US 2010/0300888 A1 Dec. 2, 2010

Related U.S. Application Data

(60) Provisional application No. 61/181,479, filed on May 27, 2009.

(51) Int. Cl.
*C25D 5/18* (2006.01)
*C25D 7/12* (2006.01)

(52) U.S. Cl.
USPC ..... 205/104; 205/103; 205/123

(58) Field of Classification Search
USPC ..... 205/103, 104
See application file for complete search history.

(56) References Cited

U.S. PATENT DOCUMENTS 3,956,120 A 5/1976 Kardos et al.
4,272,335 A 6/1981 Combs
4,461,680 A * 7/1984 Lashmore ..... 205/104
5,252,196 A 10/1993 Sonnenberg et al.
5,385,661 A 1/1995 Andricacos et al.
5,972,192 A 10/1999 Dubin et al.
6,113,771 A 9/2000 Landau
6,126,798 A 10/2000 Reid et al.
6,156,167 A 12/2000 Patton et al.
6,179,982 B1 1/2001 Ting et al.

(Continued)

FOREIGN PATENT DOCUMENTS

WO WO01/29548 4/2001
WO WO2010/138465 12/2010

OTHER PUBLICATIONS

Akolkar et al., "Pattern Density Effect on the Bottom-Up Fill During Damascene Copper Electrodeposition," Electrochemical and Solid-State Letters, 10 (6) D55-D59 (2007).

(Continued)

*Primary Examiner* — Patrick Joseph Ryan
*Assistant Examiner* — William Leader
(74) *Attorney, Agent, or Firm* — Weaver Austin Villeneuve & Sampson LLP

(57) ABSTRACT

A plating protocol is employed to control plating of metal onto a wafer comprising a conductive seed layer. Initially, the protocol employs cathodic protection as the wafer is immersed in the plating solution. In certain embodiments, the current density of the wafer is constant during immersion. In a specific example, potentiostatic control is employed to produce a current density in the range of about 1.5 to 20 mA/cm2. The immersion step is followed by a high current pulse step. During bottom up fill inside the features of the wafer, a constant current or a current with a micropulse may be used. This protocol may protect the seed from corrosion while enhancing nucleation during the initial stages of plating.

14 Claims, 10 Drawing Sheets

U.S. PATENT DOCUMENTS

| | | | | |
|---|---|---|---|---|
| 6,183,888 | B1 * | 2/2001 | Alperine et al. | 428/670 |
| 6,203,684 | B1 | 3/2001 | Taylor et al. | |
| 6,261,433 | B1 | 7/2001 | Landau | |
| 6,297,157 | B1 | 10/2001 | Lopatin et al. | |
| 6,309,528 | B1 * | 10/2001 | Taylor et al. | 205/103 |
| 6,562,204 | B1 | 5/2003 | Mayer et al. | |
| 6,569,299 | B1 | 5/2003 | Reid | |
| 6,592,737 | B1 * | 7/2003 | Robertson | 205/81 |
| 6,746,591 | B2 | 6/2004 | Zheng et al. | |
| 6,793,796 | B2 | 9/2004 | Reid et al. | |
| 6,913,680 | B1 | 7/2005 | Zheng et al. | |
| 6,946,065 | B1 * | 9/2005 | Mayer et al. | 205/102 |
| 8,048,280 | B2 | 11/2011 | Mayer et al. | |
| 2003/0102223 | A1 | 6/2003 | Shimo et al. | |
| 2003/0183527 | A1 * | 10/2003 | Collins | 205/103 |
| 2007/0261963 | A1 * | 11/2007 | Han et al. | 205/81 |
| 2009/0038950 | A1 * | 2/2009 | Zhang-Beglinger et al. | 205/257 |

OTHER PUBLICATIONS

Mayer, Steven Thomas, "Theories of Nucleation and Growth by Electrocrystalization," An In Situ Study of the Anodic Film Formation of Cu, Ag, and Zn in Alkaline Media, Lawrence Berkeley National Laboratories Report #LBL 28085, Chapter 4, Dec. 1, 1989.

Alan West et al., "Pulse Reverse Copper Electrodeposition in High Aspect Ratio Trenches and Vias," J. Electrochem. Soc., Sep. 1998.

International Search Report and Written Opinion for Application No. PCT/US2010/035991 mailed Dec. 23, 2010.

PCT International Preliminary Report on Patentability dated Dec. 8, 2010 issued in Application No. PCT/US2010/035991.

KR Office Action dated Apr. 30, 2012 issued in Application No. 10-2011-7031103.

* cited by examiner

PULSE SEQUENCE FOR PLATING ON THIN SEED LAYERS

CROSS-REFERENCE TO RELATED APPLICATIONS

This application claims benefit under 35 U.S.C. §119(e) to U.S. Provisional Application No. 61/181,479, filed May 27, 2009, which is herein incorporated by reference.

FIELD OF THE INVENTION

This invention relates to electroplating methods and apparatus. More specifically, this invention relates to an electroplating method for depositing electrically conductive materials on a semiconductor wafer for integrated circuit manufacturing.

BACKGROUND

Currently in damascene processes for forming copper interconnects, physical vapor deposition (PVD) is employed to first form a diffusion barrier layer and then a conductive seed layer. The barrier layer is often made from a refractory metal or metal nitride, and is sometimes provided as a bilayer (e.g., Ta/TaN), while the seed layer is made from copper or a copper alloy. After these PVD layers are formed on an etched dielectric layer, copper is electrodeposited on the seed layer, preferably uniformly across the wafer surface and without forming voids in the features (e.g., trenches and vias provided on the dielectric layer). As features become smaller with advancing technology nodes, the thickness of PVD seed in these high aspect ratio features is reduced in order to prevent pinch-off problems. The thinner copper seed layer often results in marginal coverage within the features, especially along the sidewalls, thereby posing a challenge to obtain void-free fill during subsequent electroplating.

SUMMARY

A plating protocol is employed to control plating of copper onto a semiconductor wafer comprising a conductive seed layer. Initially, the protocol employs cathodic protection as the wafer is immersed in the plating solution. In certain embodiments, the current density of the wafer is substantially constant during immersion. In a specific example, the wafer potential is controlled to produce a current density in the range of about 1.5 to 20 mA/cm2 for about 100 milliseconds or less. The immersion step is followed by a high current pulse step having a current density of at least about 20 mA/cm2 for a period time in the range of about 20 to 1000 milliseconds. This process may protect the seed from corrosion while enhancing nucleation during the initial stages of plating.

During the bottom up copper fill of features of the wafer (i.e., electrofill on the seed layer), which may be performed after the high current pulse, one or more current "micropulses" are applied to the wafer. In a specific example, the baseline current density is about 1 to 20 mA/cm2, with a micropulse having a magnitude of about 10 to 40 mA/cm2 above the baseline current density. This process may achieve uniform fill rate across an array of features by combining the benefits of a low current and a high current process during electrofill.

In one embodiment, a process for controlling the plating of copper interconnects on a semiconductor wafer includes immersing a plating surface of the wafer in a plating bath comprising a copper salt and a suppressor. During substantially the entire time of the immersion of the plating surface, a cathodic current in the range of about 1.5 to 20 mA/cm2 is applied to the wafer. Then, within less than about 1000 ms of completing the immersion step, a cathodic current pulse having a magnitude of at least about 20 mA/cm2 and a duration of about 20 to 1000 ms is applied to the wafer. Within less than about 1000 ms of the current pulse, bottom up copper fill is conducted at a baseline current density of about 1 to 20 mA/cm2.

In a further embodiment, the bottom up copper fill is conducted with a micropulse waveform having a baseline current density of about 1 to 20 mA/cm2. The micropulse waveform includes a micropulse having a magnitude of about 10 to 40 mA/cm2 above the baseline current density and a period of about 50 to 500 ms.

In one embodiment, a process for controlling the plating of copper interconnects on a semiconductor wafer includes immersing a plating surface of the wafer in a plating bath comprising a copper salt and a suppressor. During substantially the entire time of the immersion of the plating surface, a cathodic current in the range of about 1.5 to 20 mA/cm2 is applied to the wafer. Then, within less than about 1000 ms of completing the immersion step, a cathodic current pulse having a magnitude of at least about 20 mA/cm2 and a duration of about 20 to 1000 ms is applied to the wafer. Within less than about 1000 ms of the current pulse, bottom up copper fill is conducted at a baseline current density of about 1 to 20 mA/cm2. The baseline current density includes a plurality of micropulses having a magnitude of about 10 to 40 mA/cm2 above the baseline current density and a duration of about 1 to 495 ms. The time interval between micropulses is about 50 to 500 ms. The magnitude of each micropulse, the duration of each micropulse, or the time interval between any two micropulses is stochastic.

In one embodiment, an electroplating apparatus includes one or more electroplating chambers and one or more robots capable of transferring semiconductor wafers. The apparatus also includes a power supply with an associated controller for executing a set of instructions. The set of instructions include instructions for applying a fixed cathodic potential to a wafer during immersion, removing the fixed cathodic potential upon an indication that the wafer is fully immersed in a plating bath, applying a high current pulse within less than about 1000 ms after removing the fixed cathodic potential, and transitioning to a current appropriate for bottom up fill. The high current pulse has a magnitude of at least about 20 mA/cm2 and a duration of about 20 to 1000 ms.

These and other features and advantages will be described below with reference to the associated drawings.

DETAILED DESCRIPTION

Figure 1A:
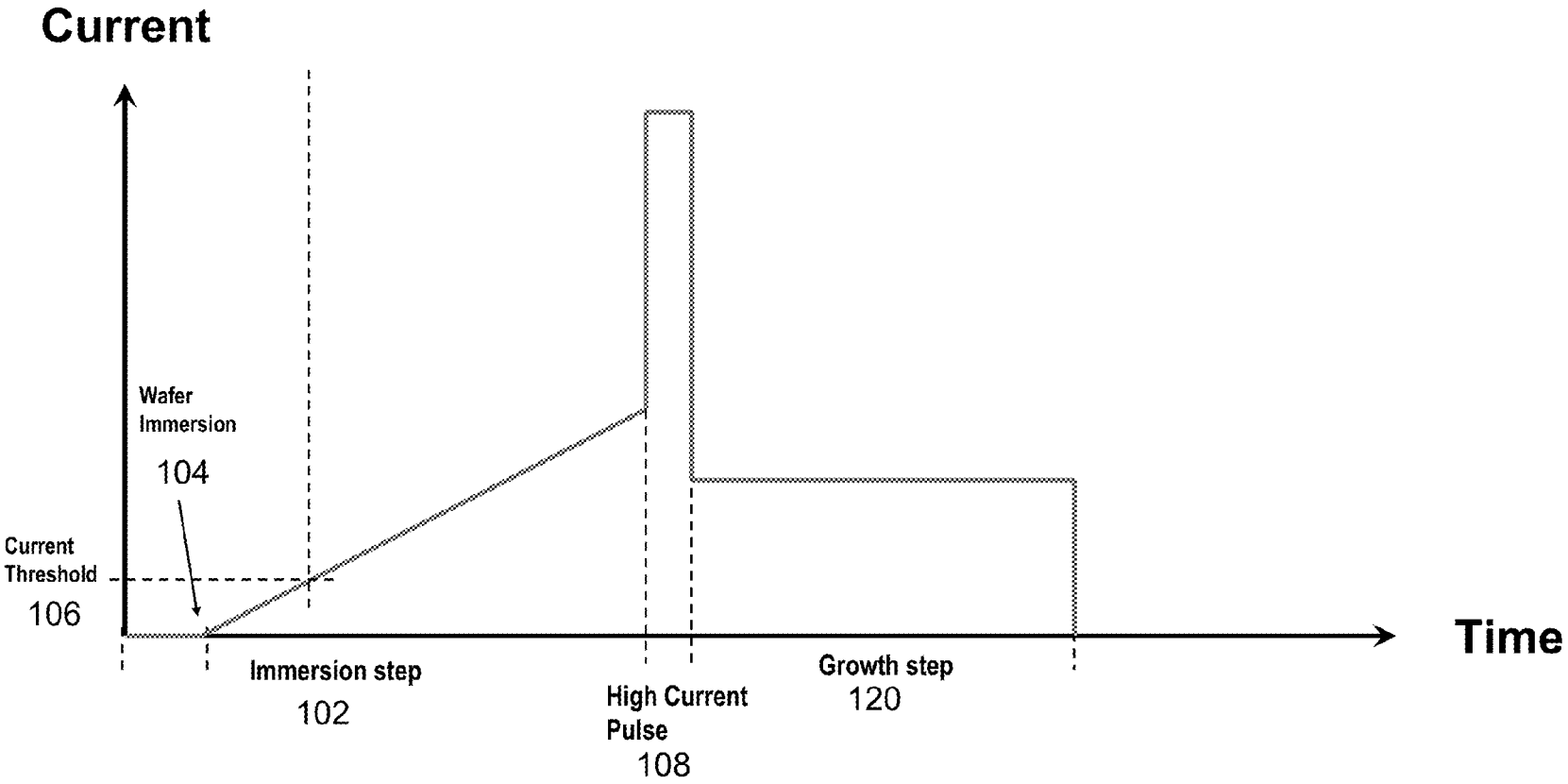
FIGS. 1A-F are plots of current versus time showing the current applied during the pulse plating process according to different embodiments.

In order to obtain void-free fill in features which have marginal seed layer coverage, appropriate process conditions should be selected that will prevent seed layer corrosion without impacting bottom up fill. Copper seed layer corrosion in acidic plating baths is commonly believed to result from one or both of two mechanisms: (i) the oxidation of the copper seed layer by oxidizing agents (e.g., dissolved oxygen) and (ii) the presence of variable seed layer roughness. Variability in copper seed micro-roughness is commonly encountered within the features, especially along the sidewalls. This variability leads to the formation of potential differences after the immersion of the wafer in the plating solution. The regions with rougher morphology are considered to have a larger surface to volume ratio and to be thermodynamically less stable than the smoother surfaces, and therefore more prone to corrosion. This is commonly referred to as Ostwald corrosion. The existence of such variability within features can further exacerbate the problem of marginal seed coverage within the features, leading to void formation. The use of sufficiently high voltages during plating can prevent the seed from undergoing either of the two forms of corrosion.

The copper seed layer is also known to have an oxide layer, which can undergo rapid dissolution when in contact with hydrogen ions present in the plating bath. In the advanced technology nodes (e.g., the 22 nanometer node and lower) the seed thickness within features can, in some embodiments, be as low as 30 to 40 angstroms (especially along the sidewalls), and could be completely converted to oxide. This may prove to be detrimental during the fill step.

Context of the Pulse Plating Process

In this disclosure various terms may be used to describe a semiconductor processing work surface; "substrate" and "wafer" may be used interchangeably. The process of depositing, or plating, a metal (e.g., copper) onto a conductive surface via an electrochemical reaction is referred to generally as electroplating or electrofilling. Bulk electrofilling refers to electroplating a relatively large amount of copper to fill features, including trenches and vias.

Plating processes described herein cathodically protect the seed layer from any of the above mentioned forms of corrosion and also enhance nucleation on the seed layer. This aids in obtaining void-free fill in a feature. In some applications, a process sequence for forming copper interconnects in a dielectric layer includes the following sequence of operations: 1) forming trench pattern in the dielectric on the wafer face with use of an etch resistant photoresist; 2) etching trench patterns; 3) removing the photoresist; 4) forming via patterns in the dielectric on the wafer face using an etch resistant photoresist; 5) etching vias; 6) removing the photoresist; 7) physical vapor deposition of a diffusion barrier layer and a conductive seed layer; 8) filling the features using a multiwave process; 9) filling the bulk of the features (i.e., bulk-fill (high current)) after bottom up fill is complete; 10) annealing; and, 11) removing copper overburden from the wafer face (e.g., by polishing), leaving copper filled in the interconnect circuitry. This sequence is non-limiting and represents one of many alternative embodiments.

The dielectric defines a metallization layer that encases copper lines in a damascene structure. The dielectric layer may be formed by various processes such as chemical vapor deposition (CVD) and may have a relatively low dielectric constant; e.g., less than about 3.5, and in some embodiments less than about 3. In some designs, the dielectric is a carbon doped oxide, which may be porous or dense. The trenches and vias are often quite small as necessitated by advanced technology nodes, such as the 45 nanometer node and beyond (e.g., the 32 nm node, the 22 nm node, and the 16 nm node). In certain embodiments, the copper line widths are about 27 nanometers or smaller, while in more specific embodiments the line widths are about 20 nanometers or smaller. In some cases, the maximum aspect ratio of a via (or trench) on a wafer is at least about 4:1 (measured as feature depth to feature width at the midpoint of depth). In further embodiments, this maximum aspect ratio is about 6:1 and 10:1.

As explained herein, in advanced technology nodes, the conductive seed layer must be relatively thin in order to avoid pinch off at the via mouth when the seed layer is deposited by PVD. In certain embodiments presented herein, the copper seed layer is, on at least some of the features within a given wafer, at most about 200 angstroms thick on the feature sidewalls. In some cases, the copper seed layer is, on average, about 10 to 100 angstroms thick at the sidewalls, and in more specific cases about 15 to 50 angstroms thick. Often, the PVD seed coverage exhibits asymmetry on the side walls of a high aspect ratio feature due to shadowing in the PVD process. This asymmetry leads to local regions of poor copper growth on one side wall, ultimately leading to voids.

In certain embodiments, the methods described herein are applied to wafers having regions of dense features such as memory arrays or gate arrays. The dense features may span an entire integrated circuit, or they may be limited to certain portions of the integrated circuit. As explained below, regions of dense features may cause concentration gradients in plating additives such as suppressors, leading to uneven fill characteristics between edge features and central features in the dense feature regions. As used herein, a dense feature region will have at least five features with critical dimensions of about 1 μm or less and spacings of about 0.5 μm or less. In some embodiments, dense feature regions will have at least about 20 features with critical dimensions of approximately 0.1 μm or less and spacings of about 0.1 μm or less. As an example, dense memory arrays in 32 nm technology node (and below) have at least 100 features with critical dimensions of 0.05 μm or less and spacings of 0.05 μm or less. In some embodiments, the wafer has at least some features with widths of about 40 nm or smaller.

In certain embodiments, a multiwave process, such as that represented in operation 8) of the above sequence, includes the following electrically controlled sub-operations: 1) immersing the wafer in electrolyte under conditions providing mild cathodic protection; 2) applying a high current pulse process for a short duration of time; and 3) completing plating of the metal with a constant or pulsed current DC (direct current) process. In other embodiments, the multiwave process does not include operation 2), applying a high current pulse process for a short duration of time.

Thus, embodiments described herein provide a three-stage (or in some cases a higher number of stages, and in some cases a lower number of stages) process for plating metal onto a wafer having a thin conductive seed layer. In some embodiment, the first two stages of the process serve as the initial part of a copper electrofill operation. These stages can protect a copper seed layer during immersion in an electrolyte and for a period thereafter until sufficient copper is plated that no further (or minimal) protection is necessary. As indicated, the seed layer is typically made from a metal such as copper which may oxidize during transport to a plating tool. Metal oxide, such as cupric oxide, can dissolve in the electroplating bath, which may be an acidic solution, if the metal oxide is not cathodically protected. An example of the current applied during a multiwave process is shown in FIG. 1A, discussed further herein.

Figure 1B:
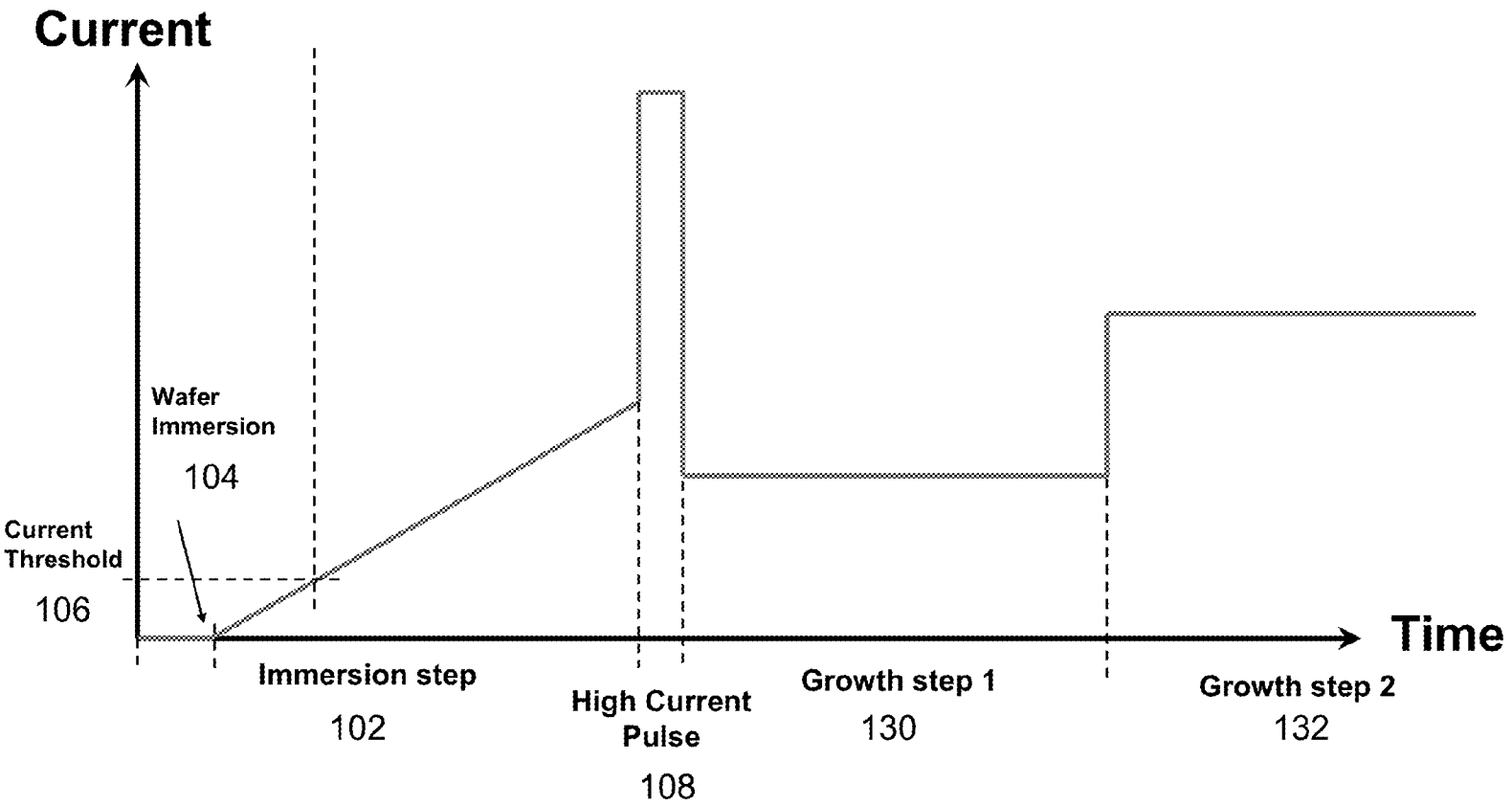

In certain embodiments, multiwave process operation 3) (completing plating) is conducted in two phases or steps, a first growth phase and a second growth phase. The second growth phase is conducted at a higher current and may be used for rapid fill of low-aspect ratio features and/or overburden growth. An example of the current applied during such a multiwave process is shown in FIG. 1B, discussed further herein.

Figure 1C:
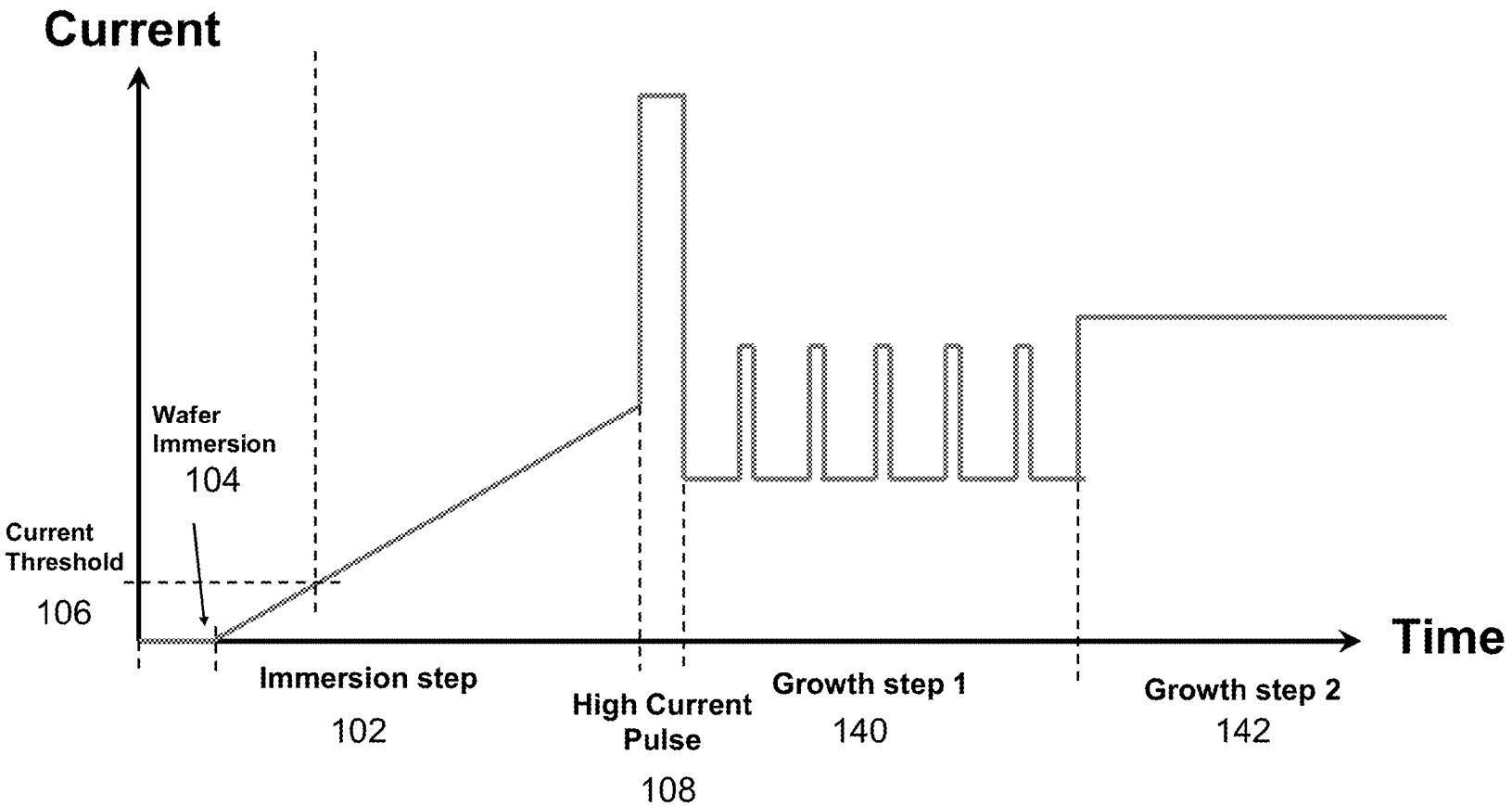

In further embodiments, the first growth phase has a micropulse waveform that includes a micropulse. An example of the current applied during this multiwave process is shown in FIG. 1C, discussed further herein. An enlarged view of the micropulse waveform in shown in FIG. 1E.

Figure 1D:
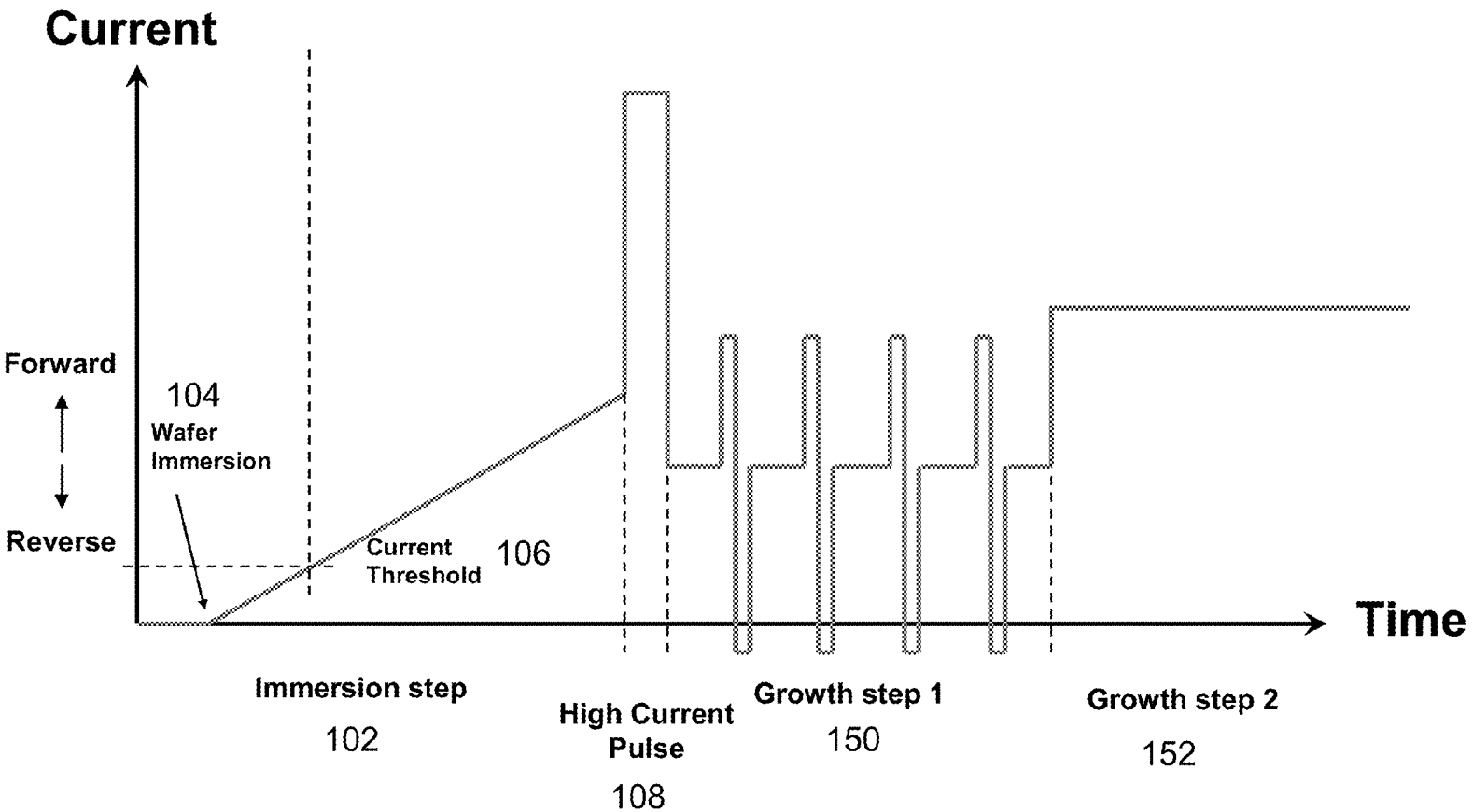
Figure 1E:
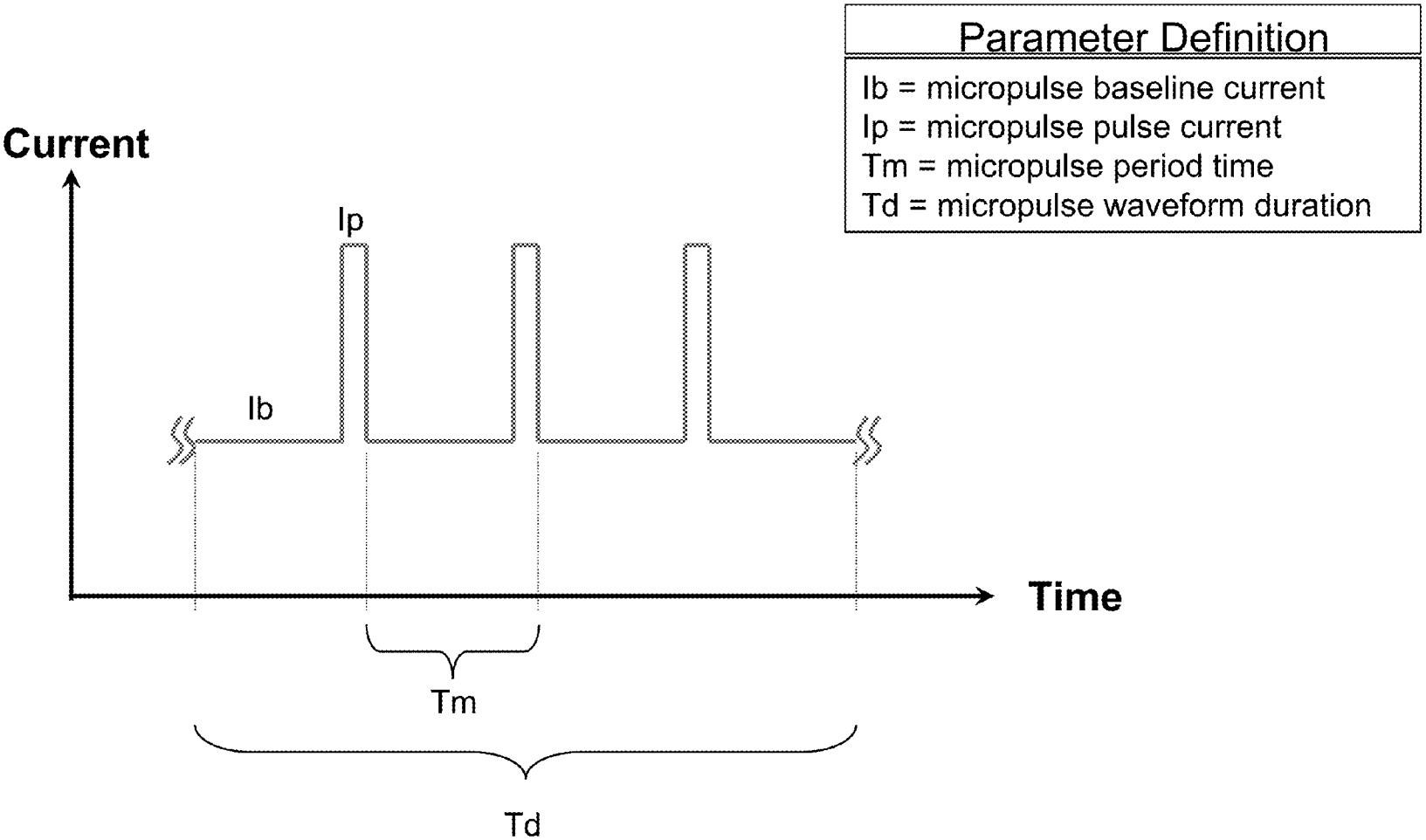
Figure 1F:
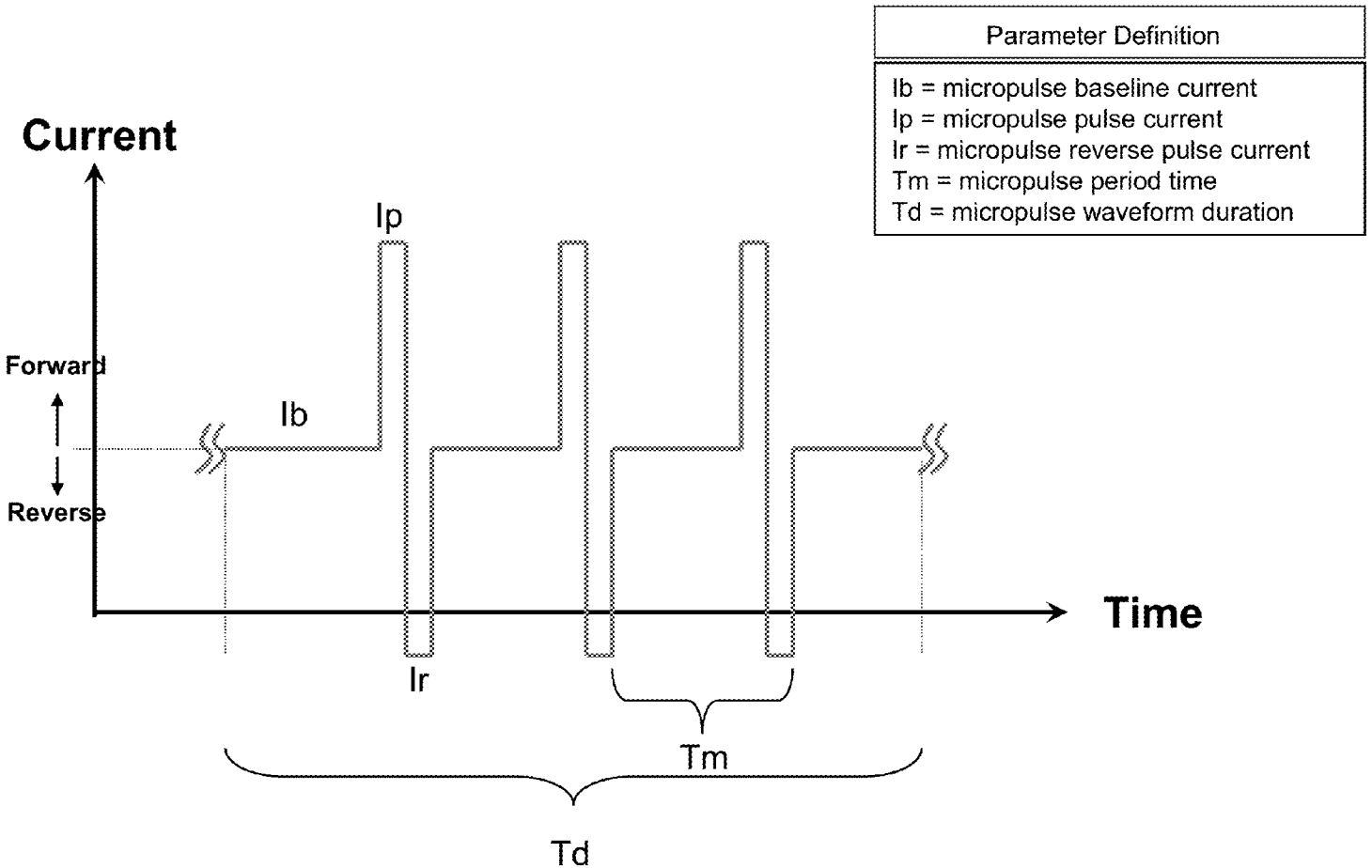

In yet further embodiments, the first growth pulse phase has a micropulse waveform that includes a forward and a reverse micropulse; i.e., one micropulse is above a baseline current and another micropulse is below a baseline current. An example of the current applied during this multiwave process is shown in FIG. 1D. An enlarged view of the micropulse waveform is shown in FIG. 1F.

Processes described herein are considered to enhance the electrofill process by protecting the seed from corrosion, enhancing nucleation and growth in damascene features during the initial stages of plating, and redistributing suppressor.

First Stage

This first stage is performed while the semiconductor wafer plating surface is being immersed in the plating bath, and may be terminated at, or soon after, the point when the entire plating surface is immersed. This is shown as 102 in FIGS. 1A-D. In some embodiments, this stage is terminated within about 50 milliseconds after immersion is complete (i.e., the wafer plating surface is completely immersed in the plating bath), or in more specific embodiments, within about 20 milliseconds after immersion is complete. In some cases, the first stage is completed nearly immediately after immersion is complete; i.e., less than about 10 milliseconds (or even 5 milliseconds) after immersion is complete. Thus, the stage effectively coincides with the immersion of the wafer plating surface.

Typically, the total duration of the first stage is about 100 milliseconds or less, and in some embodiments, about 50 milliseconds or less. In some cases, the stage is completed within about 25 milliseconds or less. Of course, the total length of time required to complete the process will be determined to some degree by the characteristics of the wafer (including size and shape) as well as the characteristics of the plating tool, which may, for example, require angled immersion of the wafer.

During this immersion stage, the wafer seed layer is cathodically protected from corrosion (e.g., it is protected from conversion to oxide and subsequent dissolution of the oxide as could happen if the wafer was held at open circuit potential). Typically, the wafer seed is held at a potential cathodic to the Cu(0)/Cu++electrochemical couple. In certain embodiments, the wafer seed is held at a potential of about 50 and 200 mV cathodic of a copper reference electrode. In other embodiments, the wafer seed is held at a potential of about 500 mV cathodic of a copper reference electrode. However, in many embodiments, little if any plating occurs during this stage due to the short time required to effect immersion. This may be accomplished by controlling the current density on the plating surface.

In some cases, the current density is held substantially uniform during the entire immersion process. In such cases, galvanostatic control may not be appropriate, but potential control techniques will generally suffice. In alternative embodiments, the current density may vary during the immersion process, but in general it will remain within a window where it provides cathodic protection without reaching a level where it can damage the wafer features (e.g., a level of about 25 mA/cm2 or greater). In certain embodiments, the current density across the wafer during immersion is about 1.5 and 20 mA/cm2, or in more specific embodiments about 5 and 18 mA/cm2. In a specific embodiment, the current density during this first stage has a nominal value of about 15 mA/cm2.

In various implementations, the wafer entry into the plating solution occurs at an angle in order to, e.g., avoid trapping of air bubbles. In certain embodiments, the wafer is immersed at an angle of about 1° to 10° with respect to the surface of the plating bath (i.e., the wafer and the surface of the plating bath have an about 1° to 10° angle between them). In a specific embodiment, the angle of entry is about 3°. The rate of entry into the plating bath is typically between about 50 to 500 mm/second (about 200 mm/second in specific example) in the vertical direction (i.e., the vertical direction being normal to the plating bath surface; a 200 mm long rod, for example, would be immersed in the plating bath in 1 second with a 200 mm/second rate in the vertical direction). A non-zero angle of entry into the plating bath may be used to minimize trapped air on the surface and in the features of the wafer. In some embodiments, the wafer is rotated during entry into the plating solution at about 1 rpm to 300 rpm, and in a specific embodiment, the wafer is rotated at about 12 rpm during entry into the plating solution.

Even if the wafer is not intentionally immersed at an angle, however, its entire surface will not be submerged in the plating bath at the same instant. There will always be a portion of the wafer surface that contacts the solution first; then, over the time it takes to fully immerse the surface, the fraction of the surface contacting the solution will gradually increase. This means that if a fixed current is applied to the wafer, the portion of the wafer first contacting the bath will experience a very high current density, which can lead to defects, especially at the first point of entry. Additionally, very high current densities can lead to increased surface roughness due to copper depletion.

To control the current density during the first stage, potentiostatic control may be employed, as noted above. By holding the wafer potential substantially constant and slightly cathodic of the copper/copper ion electrochemical couple during immersion, a constant current density can be maintained even as the fraction of the seed layer contacting the plating solution increases. In alternative embodiments, a current controlled immersion step is performed. In such embodiments, the current controller gradually increases total current to the wafer to match (at least approximately) the fraction of the wafer surface contacting the plating bath.

A potentiostatic entry step maintains the wafer surface at a substantially constant potential (e.g., in some embodiments, 0.5 V versus a copper reference electrode) during the immersion step, as the flat surface first contacts the plating bath over a limited area and then gradually contacts more and more area until the entire front surface contacts the bath. The current passing through the wafer during the immersion step gradually increases in proportion to the fraction of the surface area contacting the plating bath. However, the current density remains substantially constant. In various embodiments, the total current applied to the wafer during the first stage increases monotonically during immersion.

The current flow begins as soon as the wafer comes in contact with the plating solution in this first stage (102), shown at 104 in FIGS. 1A-D. This may be accomplished by holding the wafer at a cathodic potential prior to immersion. As mentioned, the total time for immersion of the wafer plating surface (and hence the total time of the first stage) depends on the application and the nature of the wafer. In certain cases, the total time of the immersion is about 5 and 60 milliseconds, and in more specific cases, about 10 and 40 milliseconds. As mentioned, the first stage electrical condition generally, though not necessarily, matches the physical immersion time.

The plating system may determine when the wafer has been fully immersed in the plating bath. Various techniques can be employed to determine when this has occurred. In one technique, the power supply starts a timer when a threshold current 106 is attained and the transition to the high current pulse step begins, in some embodiments, as soon as the timer expires. For example, a threshold current of about 1 Amp is used in some embodiments. When such threshold current is reached, a timer starts, and the plating process changes to another current or stage after a set duration of time elapses. After set time ends, the process transitions to the second stage. The timer/threshold current process has been found to ensure that the time required for complete immersion of the wafer can be determined fairly accurately.

Certain other embodiments involve transitioning to the second stage when it is determined that the current associated with the potentiostatic entry has reached a plateau or steady-state. Further embodiments use an AC impedance approach which measures cell resistance. A small AC current is sent across the wafer and the resulting voltage characteristics are measured to determine the impedance. When the resistance component of the impedance reaches a threshold, the power supply may start a timer. Yet further embodiments use a position detection approach. The position detection may be performed mechanically or optically, for example. Based on the wafer immersion parameters (e.g., rate of translation in the vertical direction), the time at which the wafer is completely immersed in the plating bath can be determined.

The following patents and patent application are incorporated herein by reference for their description of wafer immersion processes, particularly potential controlled wafer immersion processes, and apparatus useful for performing certain embodiments described herein: U.S. Pat. Nos. 6,562,204 and 6,946,065, and U.S. patent application Ser. No. 11/228,712, filed Sep. 16, 2005, entitled "PROCESS FOR ELECTROPLATING METALS INTO MICROSCOPIC RECESSED FEATURES," all of which are herein incorporated by reference.

Second Stage

This stage in the sequence is a high current pulse step with current densities ranging from, e.g., about 50 to 150 mA/cm2, or about 50 to 100 mA/cm2 in more specific embodiments. In other embodiments, the high current pulse has a current density of about 20 to 150 mA/cm2, or about 20 to 100 mA/cm2 in more specific embodiments. In one embodiment, the high current pulse has a current density of about at least about 20 mA/cm2, and in another embodiment, the high current pulse has a current density of about 20 to 40 mA/cm2. In general, for all of these embodiments, the current density of the high current pulse is higher than the current density of the cathodic current applied to the wafer during immersion of the plating surface. For a 300 millimeter wafer, this (i.e., 20 to 150 mA/cm2) roughly translates to about 14 to 110 Amps total current. The high current pulse typically has a duration of about 20 to 1000 ms, or about 100 to 600 ms in more specific embodiments. In a specific embodiment, the current density is about 40 mA/cm2 and the duration is about 300 ms. This second stage is 108 in FIGS. 1A-D.

The location of this high current step in the plating sequence occurs immediately after the wafer is completely immersed and lasts for a short duration, as mentioned. Use of high current steps for a long time interval could lead to slowing of the bottom up fill rate and result in void formation. In some cases, a single high current pulse is employed. In alternative embodiments, multiple such pulses are applied in succession. Between each such pulse, the power to the wafer may be turned off. However, in some cases, the current is maintained at a low cathodic value, e.g., corresponding to a current density of about 0 and 20 mA/cm2.

A noteworthy feature of this entry sequence is that the off time between first and second stages (and between the second and third stages, in some cases) is sufficiently short that wafer-electrolyte interface does not have a chance to electrically decay to a state that would compromise cathodic protection and allow the seed layer to corrode. Because the power supply transitions from one state to another between stages, it may turn off for a short interval, and during this interval the plating cell is an open circuit condition. During the immersion process, an electrical boundary layer (sometimes termed a "double layer") exists in the vicinity of the wafer's surface and behaves as a capacitor. Once the external power source is turned off, this double layer will discharge in a short period of time (approximately 20 ms for typical plating baths used for producing copper interconnects). Having an off time (between the first and second stages) on the order of or lower than the time constant associated with decay of the electrolyte double layer (e.g., about 20 ms) ensures that the wafer is not at open circuit voltage, and hence prevents chemical corrosion reactions from occurring. In some embodiments, the time between stages is less than about 1000 ms. In certain embodiments, the time between stages is no greater than about 20 ms or 10 ms, and in more specific embodiments, this time is no greater than about 1 ms or even as low as about 400 microseconds.

The high current pulse may accomplish any one or more of the following: 1) enhance nucleation; 2) reduce copper oxide and prevent seed dissolution; and, 3) alter additive (e.g., suppressor) adsorption behavior to improve fill across large arrays. Use of high over potentials may increase the number of active sites during electrodeposition and thus increase nucleation density. As Equation 1 indicates, the applied overpotential is inversely proportional to the critical nucleus radius. Thus, an increase in overpotential results in smaller particle sizes and higher nucleation density. This can improve copper coverage in regions which were marginal to begin with.

$$\eta = \frac{SE}{Zer_c} \qquad \text{Equation 1}$$

Here, $\eta$ is overpotential, S is the area of one atom on the surface of the nucleus, E is the edge energy of the nucleus, Z is the atomic number, e is the charge on an electron, and $r_c$ is the critical nucleus radius.

Copper oxide, particularly cupric oxide, can be difficult to electrochemically reduce because it is a p-type semiconductor which has holes as the majority charge carrier. While not wishing to be bound by theory, it is believed that the existence of this oxide on metallic copper results in the formation of a Schottky diode. Normally, the electrons injected into the oxide during cathodic polarization combine with the holes in the semiconductor and render it less conductive. However, application of a high enough voltage can result in the breakdown of the diode characteristics and lead to injection of electrons into the conduction band, thereby reducing the oxide. This helps reduce seed layer corrosion and improve nucleation characteristics.

Figure 2:
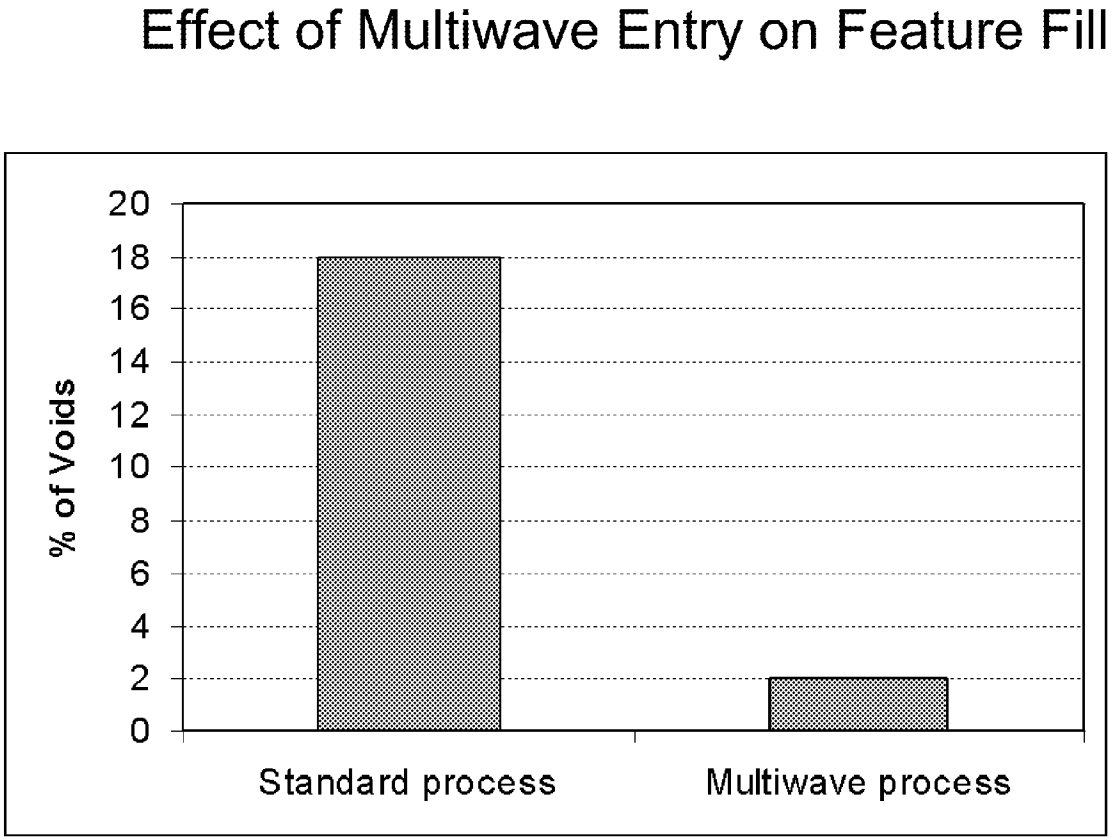
FIG. 2 is a plot showing the feature fill results of standard and multiwave processes in 60 sub-40 nm features (trenches).

FIG. 2 shows fill results comparing standard and multiwave processes in 60 sub-40 nm features (trenches). These features are considered to have marginal coverage along the sidewalls, and when using a standard plating process, this leads to a large degree of sidewall voids. A multiwave process that had an immersion current density of approximately 20 mA/cm2 and a pulse current density of approximately 40 mA/cm2 (applied for approximately 300 ms) followed by an approximately 6.5 mA/cm2 current density in the growth step (described below) resulted in a substantial reduction in voids, as shown in the bar graph. In the figure, the "% of voids" (y-axis) represents the percent of the 60 total sub-40 nm trenches observed to have voids.

Fill across high density large arrays (and other compact regions of an integrated circuit) normally encountered in semiconductor structures (such as memory structures) is found to vary depending on the location of the trenches in an array. This variation is believed to be attributable to suppressor concentration gradients across an array. Suppressors are polymers that tend to suppress current after they adsorb onto the copper surface. The effective suppressor concentration tends to be high at the leading edge (upstream) of an array, as these locations have low surface to volume ratios and decreased fill rate. In contrast, the trailing edge (downstream) of an array tends to have much higher surface to volume ratios, and hence effectively lower suppressor concentrations. The dense feature regions effectively introduce a concentration gradient in the direction of convective mass transport. The lower fill rates at certain regions of an array could potentially lead to center or seam void formation.

Figure 3:
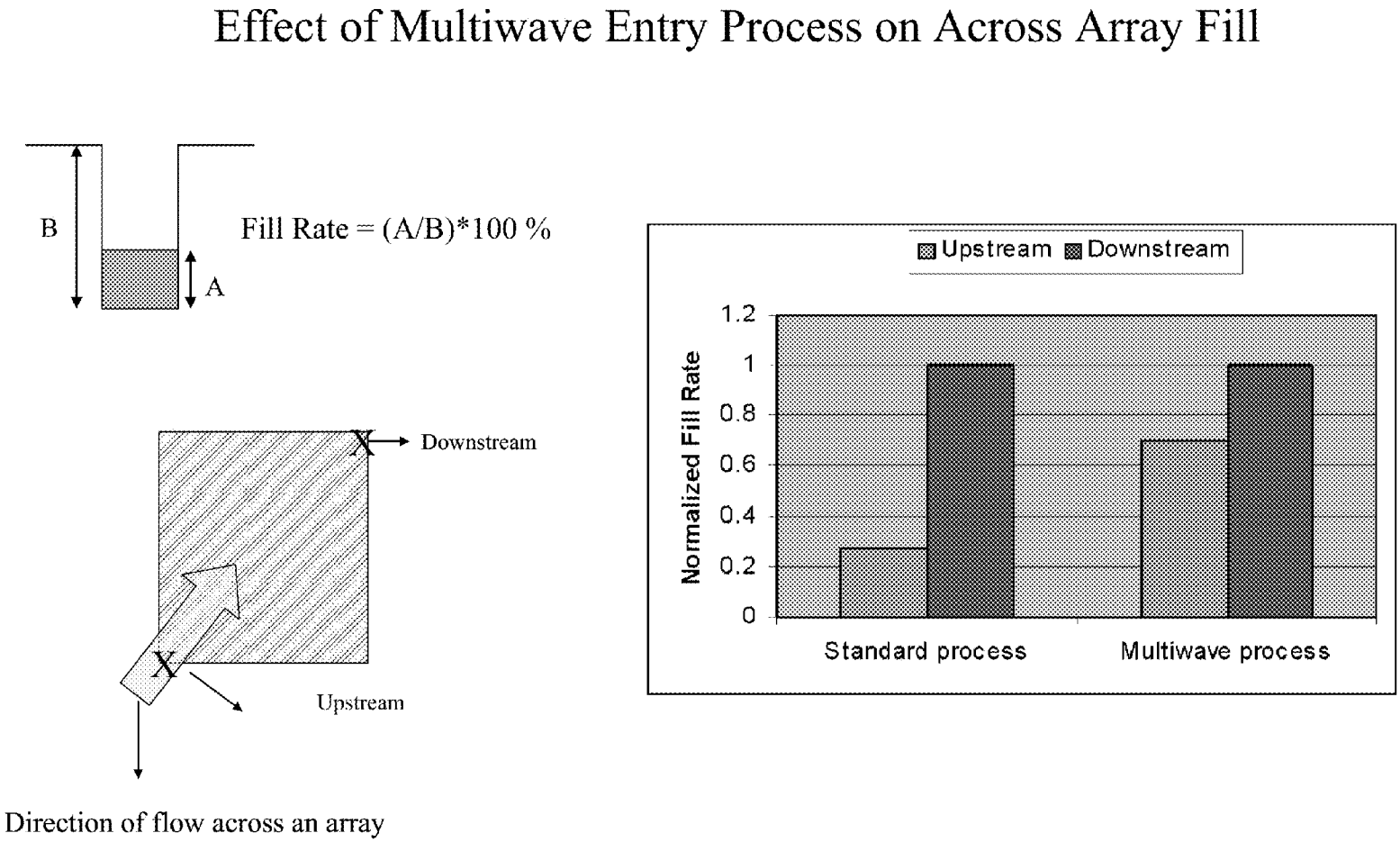
FIG. 3 is a plot showing the feature fill rate at the different locations of an array comprising sub-40 nm trenches using a standard and a multiwave process.

FIG. 3 shows the fill rate comparison at different locations of an array (i.e., an upstream and downstream location) comprising of sub-40 nm trenches using a standard and a multiwave process. In the case of the standard process, a large difference in fill rate between the upstream and the downstream locations is observed after approximately 16.5 Coulombs of charge is passed. The features at the downstream location were found to be completely filled, while for the upstream location an approximately 75% reduction in fill rate was observed. In the case of the multiwave process, complete fill in features was observed at the downstream location after the passage of approximately 16.5 Coulombs, while at the upstream location an approximately 30% reduction in fill rate was observed. Thus, a significant improvement in across array fill rate was observed using a multiwave process. In this case, the multiwave process utilized an approximately 20 mA/cm2 immersion current density and an approximately 40 mA/cm2 pulse current density followed by the use of approximately 6.5 mA/cm2 for the growth step. While not wishing to be bound by theory, these results suggest that a high current pulse may result in desorption of the suppressor and thereby eliminate or reduce the existing suppressor concentration gradients, leading to a more uniform fill across an array.

Third Stage

This stage is the growth step wherein bottom up fill inside the features starts to occur. This third stage is 120 in FIG. 1A, 130 and 132 in FIG. 1B, 140 and 142 in FIG. 1C, and 150 and 152 of FIG. 1D.

In certain embodiments, illustrated in FIG. 1A, current densities ranging from about 1 to 20 mA/cm2 are used. The off time between the second and third stages may conform to the requirements discussed above for the transition between the first stage and the second stage. That is, bottom up copper fill is conducted within less than about 1000 ms of completing the high current pulse, and in more specific embodiments, within about 20 ms, 10 ms, 1 ms, or 400 microseconds of completing the high current pulse.

Further, in certain embodiments, this third stage is conducted until bottom up fill of the features is completed (i.e., features of the wafer are substantially filled with copper), at which time the plating system enters a fourth stage, bulk electrofill. For example, a wafer having high aspect ratio features (high aspect ratio may be at least about 3:1), the third stage may conducted for a sufficiently long duration to fill all of the high aspect ratio features. Bulk electrofill is typically reserved for completion of the plating and depositing overburden. It is typically performed at a higher current than the bottom up fill case, but is otherwise performed under similar conditions. In certain implementations, the bulk electrofill is performed at current density of about 40 to 60 mA/cm2 until plating is completed.

In other embodiments, illustrated in FIG. 1B, the growth step is divided into two growth steps (130 and 132) using two different baseline current densities. In growth step 1 (130) a baseline current density of about 1 to 20 mA/cm2 is used. Growth step 1 is typically about 1 to 10 seconds in duration, and is about 1 to 5 seconds in some embodiments. In growth step 2 (132) a baseline current density of about 10 to 60 mA/cm2 is used, and in some embodiments, about 30 to 60 mA/cm2 is used. Growth step 2 is typically about 15 to 60 seconds in duration. In growth step 2 (132) wafer features are filled at a faster rate due to the higher current density. Growth step 2 is used to fill larger features. In some embodiments, growth step 2 may be unnecessary, as the features may be filled in growth step 1 (130).

In further embodiments, the growth step includes a micropulse waveform. This may be employed to promote more uniform fill rates over an array of features. The leading, center, and trailing regions of an array typically have different fill rates. It has been discovered that careful control of current, plating bath flow rate, and suppressor concentration may allow for uniform filling across these various array regions. A micropulse waveform, however, may achieve uniform filling across these various array regions in a more direct manner. One potential benefit of the micropulse waveform is achieving uniform fill rate across an array of features by combining the benefits of a low current and a high current process during electrofill.

There may be an optimum concentration of suppressor that is associated with a feature during fill. Excess suppressor in a feature can slow side wall growth in the feature, leading to disruption of bottom up fill and void formation. A shortage of suppressor in a feature can result in poor nucleation and growth of the fill.

A common problem with electrofill processes is that voids form in features at an upstream or downstream array region more so than in features at the center of the array. For example, with no flow of the plating bath across an array, suppressor in the plating bath moves in the plating bath primarily via diffusion. On the other hand, flow of the plating bath across an array, caused by rotation of a wafer, for example, leads to convection and other mass transfer transport of suppressor. Plating bath flow along the face of a rotating wafer may be radial and/or azimuthal. Along the leading edges of an array, this rotation results in high concentrations of suppressor, and along the trailing edges of an array, the rotation results in low concentrations of suppressor. Such localized suppressor concentration differences lead to defects/voids in the feature fill.

This difference between the center and the edge of an array was explained to be due to a difference in initial suppressor concentration between the center and edge of the array. (Akolkar, et al., "Pattern Density Effect on the Bottom-Up Fill during Damascene Copper Electrodeposition", Electrochemical and Solid-State Letters, 10 (6) D55-D59 (2007).) As semiconductor device features become increasingly smaller, the mass transfer and suppressor diffusion into the features on a wafer plays an ever more significant role than in previous technology generations. The inventors expanded the above initial suppressor concentration model to include a mass transfer aspect. While not wanting to be held to any theory, it is believed that the initial mass transfer of suppressor strongly modulates the degree of suppressor diffusion into the leading edge of an array and that modulating the initial mass transfer strongly modulates void density of advanced features.

Currently, it is necessary to increase the current density for filling advanced features so that suppressor diffusion into the leading edge array can be overcome. A problem with this approach is that the higher current density is not optimal for filling features at the center of the array due to more nucleation and/or growth on feature sidewalls. It is sometimes difficult to identify the "high current" setting because it is an intricate tradeoff between adequate sidewall nucleation (sidewall voids) and potential overgrowth (center voids). It is important to note that the converse is true for lower current densities. Lower current densities promote more rapid fill of features at the center of the array while features at the leading edge of the array have a significantly lower fill rate. A "low current" can therefore result in poor side wall nucleation in features at the edge of the array, with the end result being sidewall voiding. The challenge of finding the optimal current density, somewhere between "low" and "high," presents a difficult problem for achieving optimal fill uniformity and subsequent void free fill of advanced features.

In experiments performed using a test wafer having an array with features that were 0.1 μm wide with a 5:1 aspect ratio, different currents were used for bottom up fill inside the features (stage 3). In four experiments, four different currents were used: 2.25 amps, 4.5 amps, 6.75 amps, and 9 amps. In each case, sufficient charge was passed to plate 100 angstroms of copper onto the wafer (assuming a uniform deposition rate across the wafer). Higher currents (e.g., 9 amps) reduced the effect of suppressor diffusion in features in the leading edge region of the array. However, there was a significant decrease in the feature fill rate at the center of the array associated with the higher current. Lower currents (e.g., 2.25 amps) resulted in a significantly higher fill rate in features at the center of the array, but lower fill rates in features at the leading edge of the array.

In accordance with various embodiments, a micropulse waveform as described herein serves to alter differences in suppressor concentration to yield a more uniform suppressor concentration across features of an array (i.e., a normalization of the suppressor concentration gradient across the features of an array). Each micropulse may desorb suppressor molecules (due to depolarization of the suppressor molecules) from the features where they were previously adsorbed under the influence of convection. With suppressor molecules desorbed, they can redistribute among the array regions in a random manner with diffusion, thus changing the concentration profile of the suppressor across the plating surface of the wafer.

FIG. 1C is an illustration of one embodiment of a micropulse waveform. In FIG. 1C, the growth step is again divided into two growth steps (140 and 142). Growth step 1 (140) includes micropulses. In various embodiments, the micropulse waveform has a baseline current density of about 1 to 20 mA/cm2, or about 3 to 10 mA/cm2 in other embodiments. Further, in accordance with such embodiments, the micropulses have a magnitude of about 10 to 40 mA/cm2 above the baseline current density. In other embodiments, the micropulses have a magnitude of about 10 to 25 mA/cm2, and in some cases, about 10 to 60 mA/cm2, above the baseline current density. In some embodiments, the micropulse waveform has a duration of about 0.1 to 20 s, or, in other embodiments, about 3 s to 20 s. The micropulse waveform may have a period of about 50 to 500 ms in some embodiments. The duty cycle (i.e., the pulse duration divided by the pulse period) of the micropulse waveform may be about 1% to 99%, often in the range of about 25% to 75%. Thus, the duration of a micropulse may be about 0.5 ms to 495 ms. In other embodiments, the micropulse waveform has a period of about 100 to 2000 ms or about 100 to 200 ms. In further embodiments, the micropulse waveform includes a micropulse having a magnitude below the baseline current density. An enlargement of growth step 1 (140) of FIG. 1C is shown in FIG. 1E. While the embodiments in FIGS. 1C and 1E show multiple micropulses, in some embodiments, only one micropulse is used in growth step 1. Thus, embodiments may include one micropulse or a plurality of micropulses.

In some embodiments, the third stage further includes a second growth step. In growth step 2 (142), wafer features are filled at a faster rate due to the higher current density (see the general discussion above). Growth step 2 is therefore used to fill larger features.

In some embodiments that include a micropulse, current is applied to the wafer almost constantly. For example, in some embodiments, the duration in which no current is applied to the wafer between the baseline current density and a micropulse is about 1 ms or less. In other embodiments, the duration in which no current is applied to the wafer between a micropulse and the baseline current density is about 1 ms or less. These slight intervals between the different currents may be due to limitations in the power supply used to supply current, explained further below.

FIG. 1D is an illustration of another embodiment of a micropulse waveform. In FIG. 1D, the growth step is again divided into two growth steps (150 and 152). Growth step 1 (150) includes micropulses. In some embodiments, the micropulse waveform has a baseline current density of about 1 to 20 mA/cm2, or about 3 to 10 mA/cm2 in other embodiments. In this micropulse waveform, a forward micropulse has a magnitude of about 10 to 40 mA/cm2 above the baseline current density, followed by a reverse micropulse have a magnitude about 1 to 40 mA/cm2 below the baseline current density. Thus, if the magnitude of a reverse current micropulse is large enough, the reverse current micropulse will be anodic. Or, in some instances, if the magnitude of the reverse current micropulse is not such that the current is anodic at the beginning of the pulse, if the duration of the reverse current micropulse is long enough, the current may become anodic. In other embodiments, a forward micropulse has a magnitude of about 15 to 40 mA/cm2, and in some cases, about 10 to 60 mA/cm2, above the baseline current density. In further embodiments, a reverse micropulse has a magnitude of about 1 to 15 mA/cm2.

In some embodiments, the micropulse waveform has a period of about 50 to 500 ms, with the forward micropulse having a duty cycle of about 70% or less and the reverse micropulse having a duty cycle of about 70% or less. Thus, the duration of a forward micropulse may be about 350 ms or less and the duration of a reverse micropulse may be about 350 ms or less in these cases. In other embodiments, the micropulse waveform has a period of about 50 to 500 ms, with the forward micropulse having a duty cycle of about 50% or less and the reverse micropulse having a duty cycle of about 50% or less. Thus, the duration of a forward micropulse may be about 250 ms or less and the duration of a reverse micropulse may be about 250 ms or less in these cases. In further embodiments, the micropulse waveform has a period of about 100 to 2000 ms or about 100 to 200 ms. In some embodiments, the micropulse waveform has a duration of about 0.1 s to 30 s, or, in other embodiments, about 1 s to 30 s. An enlargement of growth step 1 (150) of FIG. 1D is shown in FIG. 1F. While the embodiments in FIGS. 1D and 1F show multiple forward and reverse micropulses, in some embodiments, one forward micropulse and one reverse micropulse are used in growth step 1. Thus, embodiments may include one forward micropulse and one reverse micropulse or a plurality of forward and reverse micropulses.

In further embodiments, the micropulse waveform starts with a reverse micropulse and not a forward micropulse. In yet further embodiments, two or more forward micropulses are followed by two or more reverse micropulses, which is then repeated (i.e., two forward, two reverse, two forward, etc.). The waveform may take on any number of different configurations of forward and reverse micropulses.

As explained above, in some embodiments, the third stage further includes a second growth step. In growth step 2 (152), wafer features are filled at a faster rate due to the higher current density. Growth step 2 is therefore used to fill larger features.

Further, in some embodiments employing multiple micropulses, the micropulses vary in magnitude and/or period. For example, the micropulses may increase in magnitude with each successive micropulse. The magnitude of either or both the forward micropulses and the reverses micropulses may be varied. In other embodiments employing multiple micropulses, the time interval between micropulses may vary. For example, the time interval between micropulses may be short when growth step 1 first starts, and then be further spaced apart as growth step 1 proceeds. In further embodiments employing multiple micropulses, the duration of each micropulse may vary. For example, the duration of a micropulse may be longer when growth step 1 first starts, and then be shorter as growth step 1 proceeds. These variables (i.e., micropulse magnitude, interval duration, and micropulse duration) may be varied alone or in combination.

In an alternative embodiment, the magnitude, interval, duration, and direction (i.e., forward or reverse) of micropulses may be varied stochastically. Due to the suppressor being distributed across the face of the wafer at different concentrations, depending in part on the radial position on the wafer, such a stochastic micropulse process may yield better bottom up fill across the entire surface of the wafer. In a specific embodiment, for example, the third stage bottom up fill is performed with a baseline current density of about 1 to 20 mA/cm2. A plurality of micropulses are applied, the micropulses having a magnitude of about 10 to 40 mA/cm2, a duration of about 1 to 495 ms, and a time interval between micropulses being about 50 to 500 ms. The magnitude of each micropulse, the duration of each micropulse, and the time interval between any two micropulses is stochastic.

An electroplating process using an electroplating bath containing suppressors, accelerator, and levelers, together with controlling the current density applied to a substrate, is related to the methods and apparatus described herein, and is described in U.S. Pat. No. 6,793,796, which is herein incorporated by reference.

Apparatus

Figure 4:
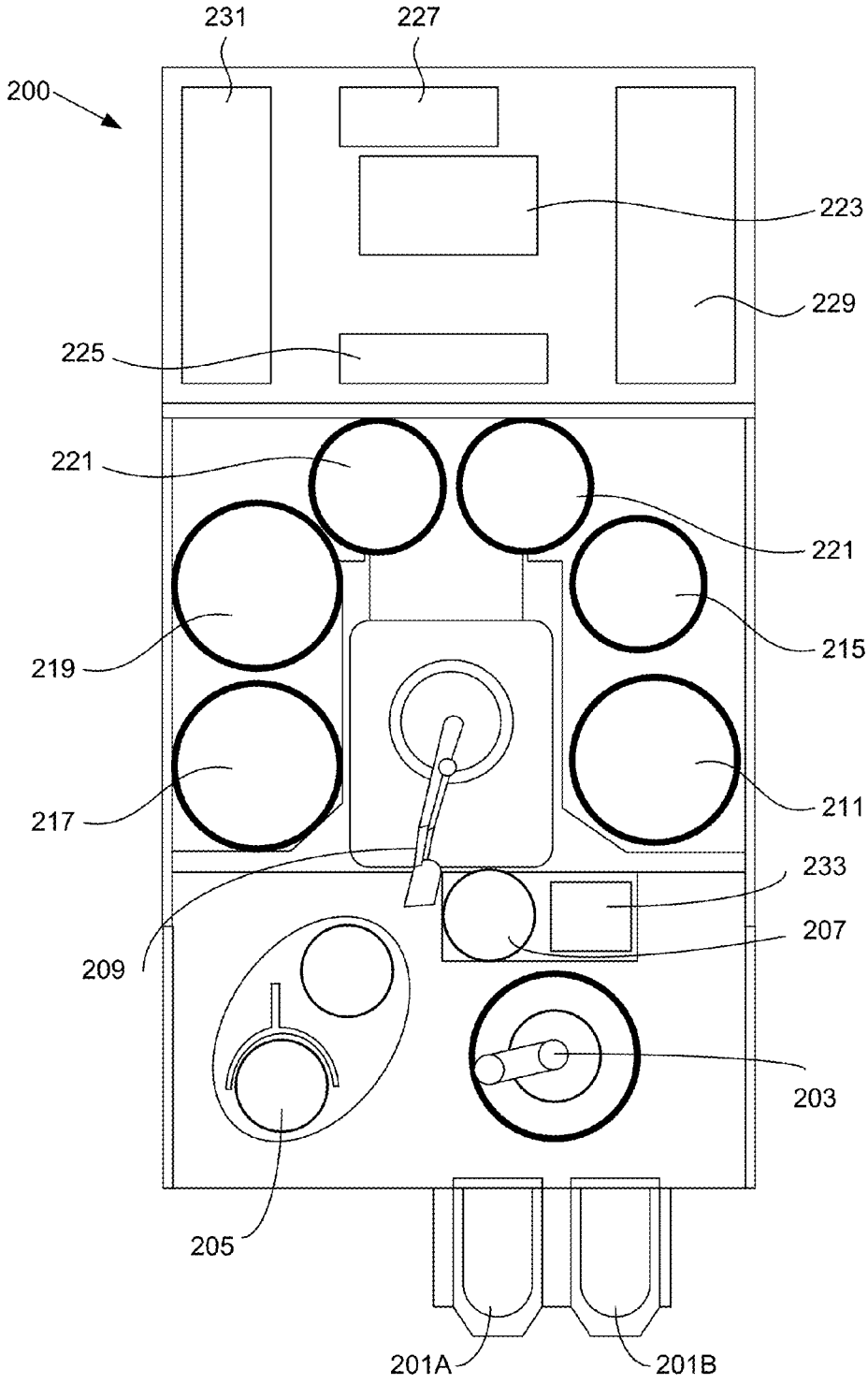
FIG. 4 depicts an example of an electroplating system suitable for use with the methods disclosed herein.

General copper electroplating hardware and processes are discussed here to provide context for the embodiments described herein. FIG. 4 depicts an electroplating system 200 as an embodiment suitable for use with the embodiments described herein. The system includes three separate electroplating or electroplating modules 211, 217 and 219. System 200 also includes three separate post electrofill modules (PEMs) 215 and 221 (two separate modules). Each PEM may be employed to perform each of the following functions: edge bevel removal, backside etching, acid cleaning, spinning, and drying of wafers after they have been electroplated by one of modules 211, 217 and 219. System 200 also includes a chemical dilution module 225 and a primary electroplating bath 223. This is a tank that holds the chemical solution used as the electroplating bath in the electroplating modules. System 200 also includes a dosing system 227 that stores and delivers chemical additives for the plating bath. A chemical dilution module 225 stores and mixes chemicals to be used as the etchant in the post electrofill modules. A filtration and pumping unit 229 filters the plating solution for central bath 223 and pumps it to the electroplating modules. Finally, an electronics unit 231 provides the electronic and interface controls required to operate system 200. Unit 231 may also provide a power supply for the system.

In operation, an atmospheric robot including a robot arm 203 selects wafers from a wafer cassette or FOUPs (front opening unified pods) such as a cassette 201A or a cassette 201B. Robot arm 203 may attach to the wafer using a vacuum attachment or some other attaching mechanism. The wafer may first be transferred to one of the electroplating modules. To ensure that the wafer is properly aligned on a transfer chamber robot arm 209 for precision delivery to an electrofill module, robot arm 203 transports the wafer to an aligner 207. In certain embodiments, aligner 207 includes alignment pins against which robot arm 203 pushes the wafer. When the wafer is properly aligned against the alignment pins, the robot arm 209 moves to a preset position with respect to the alignment pins. In other embodiments, the aligner 207 determines the wafer center so that the robot arm 209 picks up the wafer from the new position. It then delivers the wafer to an electrofill module such as electrofill module 211 where the copper is plated in accordance with embodiments described herein.

After the electroplating operation completes, robot arm 209 removes the wafer from electrofill module 211 and transports it to one of the PEMs such as module 215. The PEM cleans, rinses, and dries the wafer. Thereafter, robot arm 203 moves the wafer to one of the PEMs 221. There, unwanted copper from certain locations on the wafer (namely the edge bevel region and the backside) is etched away by an etchant solution provided by chemical dilution module 225. The PEMs 221 also cleans, rinses, and dries the wafer.

After processing in post electrofill modules 221 is complete, robot arm 209 retrieves the wafer from the module and returns it to cassette 201A or 201B. A post electrofill anneal may be completed in system 200 or in another tool. In one embodiment, the post electrofill anneal is completed in one of the anneal stations 205. In other embodiments, dedicated annealing systems such as a furnace may be used. Then the cassettes can be provided to other systems such as a chemical mechanical polishing system for further processing.

Suitable semiconductor processing tools include the Sabre System manufactured by Novellus Systems of San Jose, Calif., the Slim cell system manufactured by Applied Materials of Santa Clara, Calif., or the Raider tool manufactured by Semitool of Kalispell, Mont.

Figure 5:
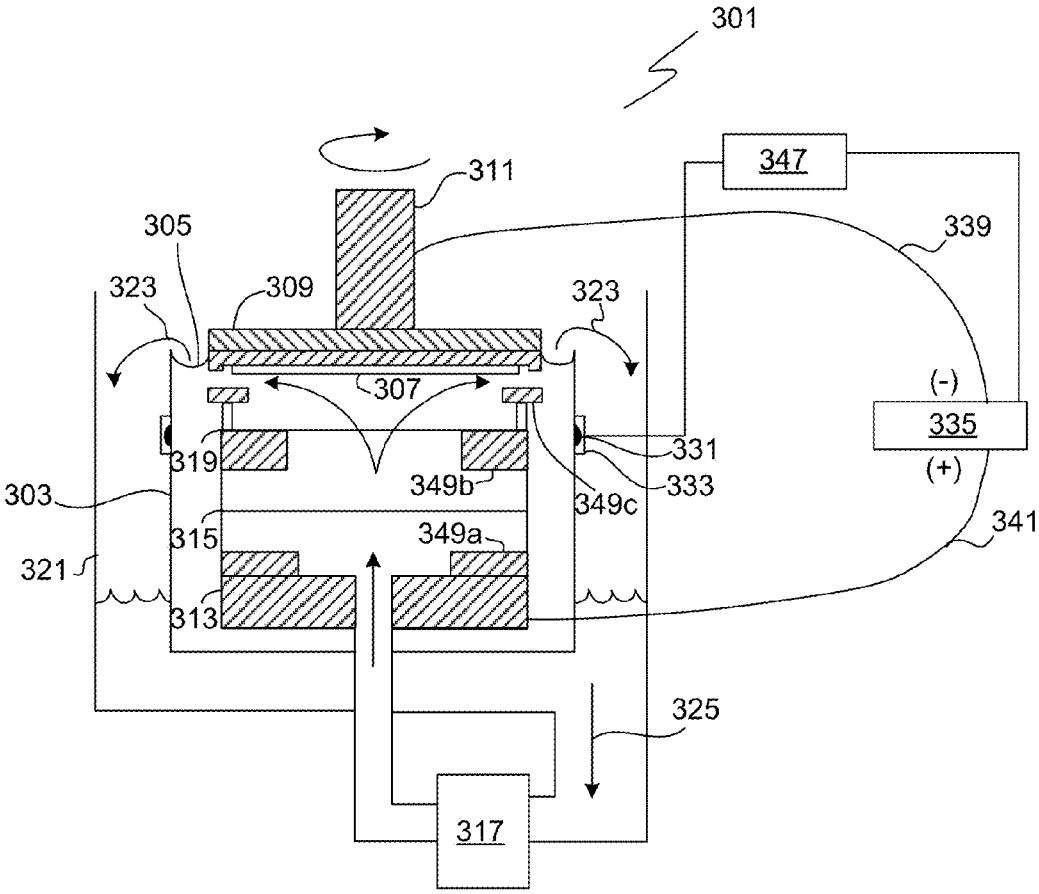
FIG. 5 is a cross-sectional view of an electroplating apparatus suitable for use with the methods disclosed herein.

Referring to FIG. 5, a diagrammatical cross-sectional view of an electroplating apparatus 301 is shown. The plating vessel 303 contains the plating solution, which is shown at a level 305. A wafer 307 is immersed into the plating solution and is held by, e.g., a "clamshell" holding fixture 309, mounted on a rotatable spindle 311, which allows rotation of clamshell 309 together with the wafer 307. A general description of a clamshell-type plating apparatus having aspects suitable for use with embodiments described herein is described in detail in U.S. Pat. No. 6,156,167 issued to Patton et al., and U.S. Pat. No. 6,800,187 issued to Reid et al, which are incorporated herein by reference for all purposes. An anode 313 is disposed below the wafer within the plating bath 303 and is separated from the wafer region by a membrane 315, preferably an ion selective membrane. The region below the anodic membrane is often referred to as an "anode chamber." The ion-selective anode membrane 315 allows ionic communication between the anodic and cathodic regions of the plating cell, while preventing the particles generated at the anode from entering the proximity of the wafer and contaminating it. The anode membrane is also useful in redistributing current flow during the plating process and thereby improving the plating uniformity. Detailed descriptions of suitable anodic membranes are provided in U.S. Pat. Nos. 6,126,798 and 6,569,299 issued to Reid et al., both incorporated herein by reference for all purposes.

The plating solution is continuously provided to plating bath 303 by a pump 317. Generally, the plating solution flows upwards through an anode membrane 315 and a diffuser plate 319 to the center of wafer 307 and then radially outward and across wafer 307. The plating solution also may be provided in the anodic region of the bath from the side of the plating cell 303. The plating solution then overflows plating bath 303 to an overflow reservoir 321 as indicated by arrows 323. The plating solution is then filtered (not shown) and returned to pump 317 as indicated by arrow 325, completing the recirculation of the plating solution. In certain configurations of the plating cell, a distinct electrolyte is circulated through the portion of the plating cell in which the anode is contained and mixing with the main plating solution is prevented using sparingly permeable membranes or ion selective membranes.

A reference electrode 331 is located on the outside of the plating vessel 303 in a separate chamber 333, which chamber is replenished by overflow from the main plating vessel. A reference electrode is typically employed when electroplating at a controlled potential is desired. The reference electrode may be one of a variety of commonly used types such as mercury/mercury sulfate, silver chloride, saturated calomel, or copper metal. In the context of this description, voltages applied to the wafer are expressed relative to the copper metal reference electrode.

A DC power supply 335 can be used to control current flow to the wafer 307. The power supply 335 has a negative output lead 339 electrically connected to wafer 307 through one or more slip rings, brushes and contacts (not shown). The positive output lead 341 of power supply 335 is electrically connected to an anode 313 located in plating bath 303. The power supply 335 and a reference electrode 331 can be connected to a controller 347, which allows modulation of current and potential provided to the elements of electroplating cell. For example, the controller may allow electroplating either in galvanostatic (controlled current) or potentiostatic (controlled potential) regime. The controller may include program instructions specifying current and voltage levels that need to be applied to various elements of the plating cell, as well as times at which these levels need to be changed. For example, it may include program instructions for transitioning from a forward current pulse (depositing copper) to an off state and on again for another forward current pulse or from potential-control to current-control upon complete immersion of the wafer into the plating bath.

During a forward current pulse, the power supply 335 biases the wafer 307 to have a negative potential relative to anode 313. This causes an electrical current to flow from anode 313 to the wafer 307, and an electrochemical reduction (e.g. $Cu2{+}{+}2e^{-}=Cu^{0}$) occurs on the wafer surface (the cathode), which results in the deposition of the electrically conductive layer (e.g. copper) on the surfaces of the wafer. During a reverse current pulse, the opposite is true. The reaction on the wafer surface is an oxidation (e.g. $Cu^{0}$->$Cu2{+}{+}2\ e^{-}$), which results in the removal of the copper.

The power supply controller is programmed or otherwise configured to implement the multiwave and micropulse processes described herein. In one embodiment, a macro or other set of instructions is loaded (at least temporarily) in the power supply controller. In many cases, the controller is configured to implement the multiwave/micropulse current profile depicted in any of FIGS. 1A-D.

In some cases, the instructions program or otherwise configure the controller to perform as follows. Initially, the controller instructs the power supply to apply a potential to the wafer such that the wafer will have a potential of about 50 to 200 mV cathodic of a copper reference electrode in the plating solution. Depending on the internal impedances of the plating system, the applied potential will be significantly greater (e.g., about 0.25 to 2 volts). The controller will receive information indicating how much current is being delivered to the wafer. In one embodiment, as depicted in FIG. 1A, when the controller detects a threshold current level, it triggers a timer which defines the remaining duration of the first stage. In certain embodiments the threshold current is the lowest current that can be reliably detected by the power supply. The time set by the timer will depend upon the speed of immersion. As indicated, the total length of time for the first stage may be on the order of about 50 ms or lower. The power supply controller may also be programmed to terminate the first stage potentiostatic control when the total current delivered to the wafer is detected to plateau.

In an alternative embodiment, the controller instructions require that the power supply supplies a monotonically ramped current to the wafer, which ramp corresponds to the fraction of the wafer immersed in the plating solution at any instant in time during the first stage.

When the power supply controller determines that the immersion stage is complete, it transitions to the high current pulse (second stage). To effect the transition, the power supply may have to turn off temporarily. The power supply controller may be programmed to limit the off phase to a very small time, e.g., about 1 millisecond or less (e.g., 500 microseconds). The above discussion of the second stage provides further details regarding the length of this off interval. The controller instructions specify the current and time duration for the pulse. This may be controlled galvanostatically. If multiple pulses are employed, the power supply controller will also program these steps.

When the instructions dictate that the second stage is complete, the power supply controller instructs the power supply to transition to the current employed for the third stage (bottom up fill). In transitioning between the second and third stages, the controller may dictate that the off period is no greater than about 1 millisecond or other appropriate length of time as explained above. The controller may also direct the power supply to transition from bottom up fill (stage 3) to a final bulk fill performed at a higher current. The controller may also direct the power supply to transition to a higher current during a later stage of the bottom up fill (stage 3, growth step 2); i.e., stage 3 may be performed at two or more different currents.

In further cases, instructions program or otherwise configure the controller to include micropulses in the third stage. In this case, when the instructions dictate that the second stage is complete, the power supply controller instructs the power supply to transition to the baseline current employed for the third stage (bottom up fill). In transitioning between the second and third stages, the power supply may dictate that the off period is no greater than about 1 millisecond or other appropriate length of time, as explained above. During the third stage, the controller instructs the power supply to add forward and/or reverse micropulses to the baseline current density. The above discussion of the third stage with respect to micropulses provides further details regarding a micropulse waveform, and allows for randomizing one or more pulsing parameters. The controller instructions specify the current, duration, and period of a micropulse waveform. If multiple micropulses are employed, the power supply controller will also program these steps. The controller may also direct the power supply to transition to a higher current during a later stage of the bottom up fill (stage 3, growth step 2); i.e., stage 3 may be performed at two or more different baseline currents.

Note that the currents, potentials, time durations, and other parameters discussed above for the three stages of the multiwave process may be programmed into the power supply controller. Those of skill in the art will appreciate that various types of controllers and instructions may be used.

The plating bath (i.e., the electrolyte) used in plating copper may be chosen as appropriate for the apparatus and application employed. In some cases, the same plating bath composition is employed through the plating process, from stage 1 to the conclusion of electrofill; however this need not be the case. In some embodiments, such as those employing a constant flow of electrolyte to the plating chamber, the electrolyte composition may vary during the course of plating. In certain embodiments, the electrolyte composition is appropriate for facilitating bottom up fill.

Copper electroplating is typically performed with a solution of a copper salt, such as $CuSO_4$, with various other additives. In one embodiment, the plating bath includes a copper salt and a suppressor. In a specific embodiment, the concentration of copper ions from the copper salt is about 20 to 60 g/L and the concentration of the suppressor is about 50 to 500 ppm. As explained above, suppressors are polymers which absorb at a copper surface and decrease the local current density at a given applied voltage, thus retarding plating. Suppressors are generally derived from polyethylene glycol (PEG), polypropylene glycol (PPG), polyethylene oxide, or their derivatives or co-polymers. Commercial suppressors include Ultrafill S-2001 from Shipley (Marlborough, Mass.) and S200 from Enthone OMI (West Haven, Conn.).

In some embodiments, the plating bath further includes an accelerator and a leveler. In a more specific embodiment, the concentration of an accelerator is about 5 to 100 ppm and a concentration of a leveler is about 2 to 30 ppm. Accelerators are additives which increase the rate of the plating reaction. Accelerators are molecules which adsorb on copper surfaces and increase the local current density at a given applied voltage. Accelerators typically contain pendant sulfur atoms, which are understood to participate in the cupric ion reduction reaction and thus strongly influence the nucleation and surface growth of copper films. Accelerator additives are most commonly derivatives of mercaptopropanesulfonic acid (MPS) or dimercaptopropanesulfonic acid (DPS.) Some useful accelerators, alternatively termed brighteners, are described, for example, in U.S. Pat. No. 5,252,196, incorporated herein by reference. Accelerators are available commercially, for example as Ultrafill A-2001 from Shipley or as SC Primary from Enthone OMI.

The effect of levelers is more complicated than the effects of the other additives, and depends on local mass transfer behavior. Levelers are typically cationic surfactants and dyes which suppress current at locations where their mass transfer rate is most rapid. The presence of levelers, therefore, in the plating bath serve to reduce the film growth rate at protruding surfaces or corners where the levelers are preferentially absorbed. Absorption differences of levelers due to differential mass transfer effects have a significant effect. The differential mass transfer rates of levelers at different locations are a result of differences in diffusion rates to different geometrical locations and of higher electrostatic migration rates to points on the surface at a more negative voltage. To take advantage of the second effect, most levelers are cationic and usually contain protonated nitrogen-based functional groups. Dodecyltrimethylammonium bromide (DTAB) is a leveler of the tetraalkylammonium class. DTAB is cationic in acidic solution and migrates and diffuses to protrusions on a wafer surface. Other specific levelers have been described, for example, in U.S. Pat. Nos. 5,252,196, 4,555,135 and 3,956,120, incorporated herein by reference. Levelers are available commercially as Liberty or Ultrafill Leveler from Shipley and Booster 3 from Enthone OMI.

In further embodiments, the plating bath further includes an acid and chloride ions. In more specific embodiments, the concentration of the acid is about 5 to 200 g/L and the concentration of the chloride ions is about 20 to 80 mg/L. In some embodiments, the acid is sulfuric acid. In other embodiments, the acid is methane sulfonic acid. These acids may be added to the plating bath to enhance its conductivity.

In a specific embodiment, the plating bath composition includes copper sulfate, sulfuric acid, chloride ions, and organic additives. In this embodiment, the plating bath includes copper ions at a concentration range of about 0.5 to 80 g/L, preferably at about 5 to 60 g/L, and more preferably at about 18 to 55 g/L and sulfuric acid at a concentration range of about 0.1 to 400 g/L. Low-acid plating solutions typically contain about 5 to 10 g/L of sulfuric acid. Medium and high-acid solutions contain sulfuric acid at concentrations of about 50 to 90 g/L and 150 to 180 g/L, respectively. The chloride ion may be present in a concentration range of about 1 to 100 mg/L. As explained above, organic additives may be included. A number of organic additives, such as Enthone Viaform, Viaform NexT, Viaform Extreme, or other accelerators, suppressors and levelers known to those of skill in the art, can be used. In a particular embodiment, the plating bath includes copper sulfate at a concentration of about 40 g/L, sulfuric acid at a concentration of about 10 g/L, and chloride ion at a concentration of about 50 mg/L.

CONCLUSION

Although various details have been omitted for clarity's sake, various design alternatives may be implemented. Therefore, the present examples are to be considered as illustrative and not restrictive, and the embodiments are not to be limited to the details given herein, but may be modified within the scope of the appended claims.

What is claimed is:

1. A method of controlling plating of copper interconnects on a semiconductor wafer, the method comprising:

(a) immersing a plating surface of the wafer in plating bath comprising a copper salt and a suppressor while applying a cathodic current to the wafer in the range of about 1.5 to 20 mA/cm$^2$ during substantially the entire immersion of the plating surface;

(b) within less than about 1000 ms of completing the immersion in (a), applying a high cathodic current pulse to the wafer, the pulse having a magnitude that is greater than any of the current densities applied in (a) and that is at least about 20 mA/cm$^2$ for a duration of about 20 to 1000 ms; and (c) within less than about 1000 ms of completing the current pulse in (b), conducting bottom up copper fill using lower current densities than the current densities of the high cathodic current pulse with a baseline current density of about 1 to 20 mA/cm$^2$ and a plurality of micropulses having a magnitude of about 10 to 40 mA/cm$^2$ above the baseline current density, the micropulses having a duration of about 1 to 495 ms, a time interval between micropulses being about 50 to 500 ms, wherein the magnitude of each micropulse, the duration of each micropulse, or the time interval between any two micropulses is random, and wherein the suppressor is distributed across the face of the wafer at different concentrations prior to (c).

2. The method of claim 1, wherein the magnitude of each micropulse is random.

3. The method of claim 1, wherein the duration of each micropulse is random.

4. The method of claim 1, wherein the time interval between any two micropulses is random.

5. The method of claim 1, wherein the magnitude of each micropulse, the duration of each micropulse and the time interval between any two micropulses are random.

6. The method of claim 1, wherein a concentration of copper ions is about 20 to 60 g/L and a concentration of the suppressor is about 50 to 500 ppm.

7. The method of claim 1, wherein the plating bath further comprises an accelerator and a leveler.

8. The method of claim 1, wherein the plating bath further comprises an acid and chloride ions.

9. The method of claim 1, wherein the wafer has at least some features with widths of about 40 nm or smaller.

10. The method of claim 1, wherein the cathodic current pulse in (b) is applied within about 20 ms of completing the immersion in (a).

11. The method of claim 1, wherein bottom up copper fill is conducted within about 20 ms of completing the current pulse in (b).

12. The method of claim 1, wherein the cathodic current applied in (a) is applied by potentiostatic control of the wafer potential.

13. The method of claim 1, further comprising:

(d) conducting a bulk electrofill after completing the bottom up copper fill in (c).

14. The method of claim 1, wherein the micropulses change a concentration profile of the suppressor across the plating surface of the wafer.

* * * * *